US005649740A

United States Patent [19]

Hodgdon

[11] Patent Number: 5,649,740

[45] Date of Patent: Jul. 22, 1997

[54] CHAIR TILT CONTROL MECHANISM

[76] Inventor: Dewey Hodgdon, 48 Forster Rd., Manchester, Mass. 01944

[21] Appl. No.: 562,915

[22] Filed: Nov. 27, 1995

[51] Int. Cl.[6] ..... A47C 3/00

[52] U.S. Cl. ..... 297/303.1; 297/325; 297/300.8; 248/575

[58] Field of Search ..... 297/303.1, 300.1, 297/300.8, 301.7, 302.7, 325, 326; 248/575, 576, 577, 578

[56] References Cited

U.S. PATENT DOCUMENTS

| | | | |
|---|---|---|---|
| 2,184,988 | 12/1939 | Collier et al. | 248/575 |
| 2,374,350 | 4/1945 | Herold | 297/303.1 X |
| 3,259,431 | 7/1966 | Gale | 297/303.1 |
| 3,309,137 | 3/1967 | Wiebe | 297/303.1 |
| 3,770,235 | 11/1973 | Klapproth et al. | 297/303.1 X |
| 4,852,943 | 8/1989 | Roper | 297/303.1 |
| 4,871,208 | 10/1989 | Hodgdon | 297/304 |

FOREIGN PATENT DOCUMENTS

| | | | |
|---|---|---|---|
| 1285138 | 12/1968 | Germany | 297/303.1 |

*Primary Examiner*—Laurie K. Cranmer
*Attorney, Agent, or Firm*—Don Halgren

[57] ABSTRACT

The present apparatus comprises a manually adjustable tilt control mechanism which permits adjustable control of the front to back tilt of a chair assembly on a support frame, including a chair assembly having a lowermost seat portion, a column and forwardly extending support arm, for supporting the chair seat portion, a pair of dissimilarly sized resilient blocks, disposed between the end of the support arm and the bottom side of the chair seat portion. The resilient blocks may be adjustably compressed or decompressed between the bottom of the seat portion and the support arm, to adjust the tiltability of the seat.

16 Claims, 2 Drawing Sheets

CHAIR TILT CONTROL MECHANISM

BACKGROUND OF THE INVENTION

1. Field of the Invention

This invention relates to chairs, and more particularly to devices which permit adjustment and control of the tilt characteristics of chairs.

2. Prior Art

Office furniture has only in last decade or so, become adaptable to the varying needs of their users. Frank Lloyd Wright's 3-wheeled chairs of the Johnson Wax Headquarters for an example of chair design that was indifferent, if not hostile toward the notion of sitting comfortably.

Office furniture in our service-based economy, of necessity, has had to have improvements in chair comfort, adaptability, and simplicity.

In my earlier U.S. Pat. No. 4,871,208, entitled "Chair Tilt Control Mechanism", which is incorporated herein by reference, in its entirety, there is shown a tilt control mechanism which included a single resilient block of rubber-like material disposed between a lower portion of a seat, and a mounting arm as part of a floor support assembly. The resilient block has an opening which is eccentrically disposed in that block. A longitudinally moveable adjustment means extended through the opening, connecting the upper and lower support plates to permit manual variation of the resilience of the block. This permitted a variation of tilt of the chair assembly in any 360° direction with respect to the frame support arrangement.

It is however, an object of the present invention to provide an improved tilt control support arrangement for a chair.

It is a further object of the present invention, to provide a tilt control arrangement, which may be adjusted to suit the needs and peculiarities of any particular chair assembly and in turn, its user, permitting chair manufacturers a pair of resilient modules of a certain resiliency to satisfy chair support and movement requirements with a simple and compact controllable rearward and forward movement control mechanism.

BRIEF SUMMARY OF THE INVENTION

The present invention relates to a chair tilt control arrangement which is designed to be fixedly disposed onto the bottom side of a chair seat, which may be molded. The chair assembly of the present invention would have a lower column support extending from a plurality of legs at its base. The column support would have a forwardly extending arm which secures to a lower plainer portion of the tilt control mechanism. The tilt control mechanism being attached, as aforementioned to the lower side of the chair seat.

The chair tilt control assembly comprises an uppermost generally rectilinear top mounting plate. The top mounting plate has a mounting hole at each corner thereof, for attachment via bolts or rivets or the like, to the seat portion of the chair. The top mounting plate has a bolt opening disposed along the longitudinal center line of the top mounting plate. The bolt opening is arranged within the forwardmost half of the top mounting plate. The tilt control mechanism also includes a lower mounting plate of generally rectilinear configuration, also having a central bolt opening there through. The lower mounting plate is fixedly attached to the distal end of the forward support arm which extends from the chair assembly column. The lower mounting plate is disposed generally parallel to the top mounting plate.

A pair of rectangularly shaped resilient support blocks are disposed between the top mounting plate and the lower mounting plate. The support blocks are formed of a forward resilient block and a rearward resilient block. Each resilient block is of the same thickness (preferably about one inch), and of the same width, (preferably generally about 4 inches wide). The forward resilient block has a forward to rearward dimension of almost about ⅓ that of the forward to rearward dimension of the rearward resilient block. The total forward to rearward dimension of the combined blocks is generally about 3 to about 4 inches. Each resilient block has a top face plate and a bottom face plate. Each face plate of each resilient block is fixedly secured as by fusing or adhesive or the like, to each respective resilient block. The top mounting plate is attached to the top face plates by a plurality of threaded inserts threaded therebetween.

The lower mounting plate and the bottom face plates of each respective resilient block are secured together through a plurality of threaded inserts through the lower mounting plates and being threadedly received in corresponding threaded holes in the bottom face plates.

The forward and rearward resilient blocks are spaced apart from one another by a gap of about ⅛ inch. The spaced apart gap between the forward and rearward resilient blocks is disposed transversely with respect to the "forward to rearward" longitudinal axis of the chair assembly and also to the longitudinal axis of the support arm.

A threaded fixed bolt extends through the central opening in the top mounting plate and extends within a channel formed in each respective contiguous side of the forward and rearward resilient blocks, which face one another, the bolt extending through the central bolt opening in the lower mounting plate, and being received into a rotatable threaded hub therebeneath. The threaded hub at the lowermost side of the lower mounting plate has an adjustment handle thereon, rotatably engaged with the threads on the lower-most end of the threaded fixed bolt extending through the tilt control mechanism.

The uppermost end of the threaded fixed bolt has a generally conical shaped head and a square shank. The top mounting plate is tiltably or pivotably matable with respect to the head of the bolt in the top mounting plate, because of the conical shape of the head of the bolt sitting in a somewhat conically shaped hole in the top mounting plate.

Movement of an individual seated in the chair seat portion of the chair assembly made by the individual's moving forward, creates a moment arm around the threaded fixed bolt, by having the forward transverse edge of the top mounting plate pivot downwardly about a short fulcrum between the longitudinal axis about the threaded fixed bolt, and the forward edge of the forward resilient block. The shorter forward to rearward dimension of the "forward" resilient block provides a less resistance to compressibility and thus an ease of pivoting the forward edge of the chair downwardly, than would a rearward moment, compressing the "rearward" resilient block, because of the "rearward" resilient block's greater rearward to forward dimension thereof. The greater mass of the "rearward" resilient lock thus providing a slightly different sized fulcrum between the rearward edge and the longitudinal axis of the compression adjuster (being the threaded fixed bolt), and thus a slightly greater resistance to a backward tilt by someone sitting in the rearmost portion of chair seat.

The threaded hub however, may be rotated with respect to the lower end of the threaded fixed bolt, so as to bring the upper support plate closer or further apart from the lower support plate, so as to compress or decompress the "forward" and "rearward" resilient blocks between the top mounting plate and the lower mounting plate, thus affecting their compressibility, and thus affecting the forward and rearward tiltability of the top mounting plate, and hence, affecting the tiltabilty of the lower support portion of the chair seat.

The invention thus comprises a manually adjustable tilt control mechanism permitting adjustable control of the front to back tilt of a chair assembly on a support frame, comprising, a chair assembly having a lowermost seat portion, a column and forwardly extending support arm, for supporting the chair seat portion, a pair of dissimilarly sized resilient blocks, disposed between the end of the support arm and the bottom side of the chair seat portion, which blocks have means for adjusting the compression or decompression thereof, to affect the tiltability of said chair seat. Each of the resilient blocks are of rectilinear shape, a first of the blocks having a forward to rearward dimension which is smaller than the forward to rearward dimension of the second of the resilient blocks. The first and second resilient blocks are separated by a transversely disposed gap extending therebetween. Each of the resilient blocks, has a top face plate and a bottom face plate, and the tilt control mechanism also includes a top mounting plate and a lower mounting plate between which the resilient blocks and top face plate and bottom face plate are sandwiched therebetween. The top mounting plate and the lower mounting plate each have a center bolt locating hole in axial alignment with one another, and wherein the resilient blocks each have a channel on their contiguous side portions, so as to permit a passageway for a threaded bolt therethrough.

The threaded bolt fits through the central openings in the top mounting plate, the lower mounting plate, and the channel between the respective resilient blocks, and mates into a threaded hub on the lower side of the lower mounting plate for adjustment of the resilient blocks therebetween. The first or forwardmost resilient block has a forward to rearward dimension which is less than the forward to rearward dimension of the second or rearward resilient block. The top mounting plate is tiltable with respect to the threaded bolt extending therethrough. The top mounting plate is attached to the lower side of the chair by a plurality of securement members therethrough. The threaded hub has a handle extending radially therefrom, to permit the threaded hub to be rotated with respect to the lower mounting plate, thereby effecting compression or decompression on the resilient blocks spaced between the top mounting plate and the lower mounting plate.

The invention also includes a method of adjusting the tiltability of a chair seat, comprising the steps of attaching a pair of differently sized resilient blocks to the lower side of the seat, arranging a support arm onto the lower side of the resilient blocks, to provide support for the chair seat, placing a compression adjustment means on the resilient blocks, so as to adjustably compress or decompress each of the blocks, and adjusting the compression adjustment means, so as to tighten and squeeze the blocks, to reduce their further compressibility, and thus reduce the tiltability of the chair seat. The method includes the steps of adjusting the compression adjustment means, so as to release and decompress the resilient blocks so as to enhance their further compressibility, and thus enhance the tiltability of the chair seat, positioning a threaded bolt through an opening between the resilient blocks, which threaded bolt is attached to the support arm, to allow adjustment of compressibility, and fixing the forward to rearward length of a forwardmost block as less than the forward to rearward length of a rearwardmost block, to effect a greater mass in the rearmost block than the forwardmost block, thus effecting differing resistance to compressibility and hence tiltability therein.

The invention also comprised a manually adjustable tilt control mechanism permitting adjustable control of the front to back tilt of a chair assembly on a support frame, including a chair assembly having a lowermost seat portion, a column and forwardly extending support arm, for supporting the chair seat portion, a pair of dissimilarly sized resilient blocks, disposed between the end of the support arm and the bottom side of the chair seat portion, one of the blocks being compressable as the other of the blocks is stretched, to affect the tiltability of the chair seat. Each of the blocks has an upper and a lower plate attached thereto, for for securement to the seat and support arm respectively. Each of blocks are spaced apart from one another, and a compression adjustment member is disposed between the blocks, to permit adjustment and control of compression of the blocks and thereby effect the forward to rearward tilt of the chair assembly supported thereby.

Thus, what has been shown is a unique adjustable tilt control mechanism which may be tightened so as to minimize the forward and rearward tilt of a particular chair, or which may be adjusted to decompress those respective spaced apart resilient blocks, to permit a greater forward and rearward tilting of the seat portion of the molded chair assembly.

BRIEF DESCRIPTION OF THE DRAWINGS

The objects and advantages of the present invention will become more apparent, when viewed in conjunction with the following drawings, in which.

DESCRIPTION OF THE PREFERRED EMBODIMENTS

Figure 1:
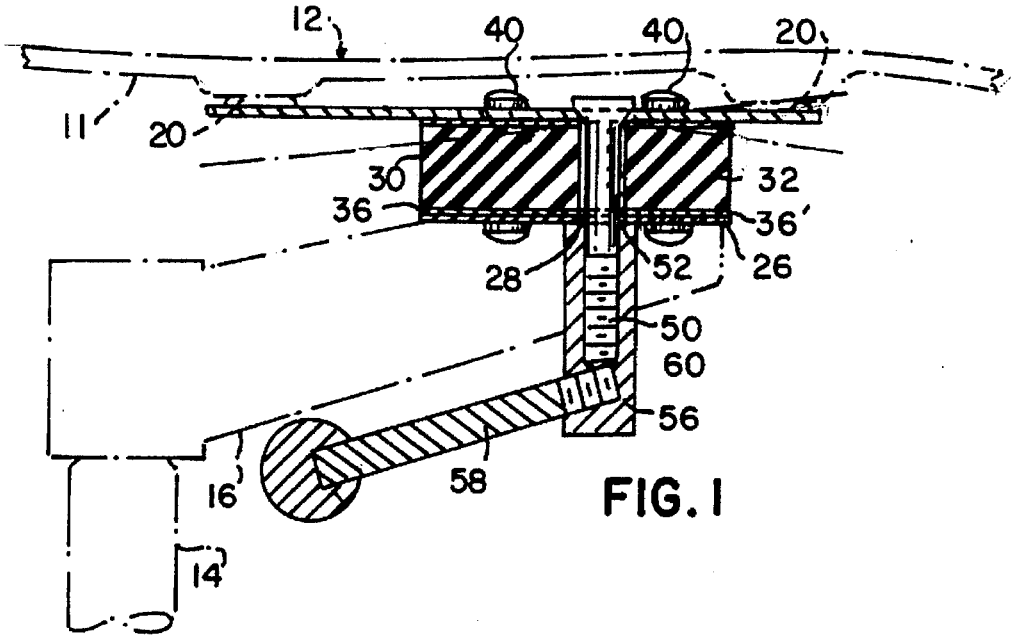
FIG. 1 is a side elevational view of a portion of a chair assembly, partly in section and partly in phantom, having a tilt control mechanism arranged therewith.

The present invention relates to a chair tilt control arrangement 10 which is designed to be fixedly disposed onto the bottom side 11 of a chair seat 12, as shown in FIG. 1. The chair seat of the present invention may be of a resinous moldable material, and would be held by a lower column support 14, shown in phantom in FIG. 1, extending from a plurality of legs at its base, not shown. The column support 14 would have a forwardly extending arm 16 which is secured to a lower planer portion of the tilt control mechanism 10. The tilt control mechanism 10 being attached, as aforementioned to the lower side 11 of the molded chair seat 12.

Figure 2:
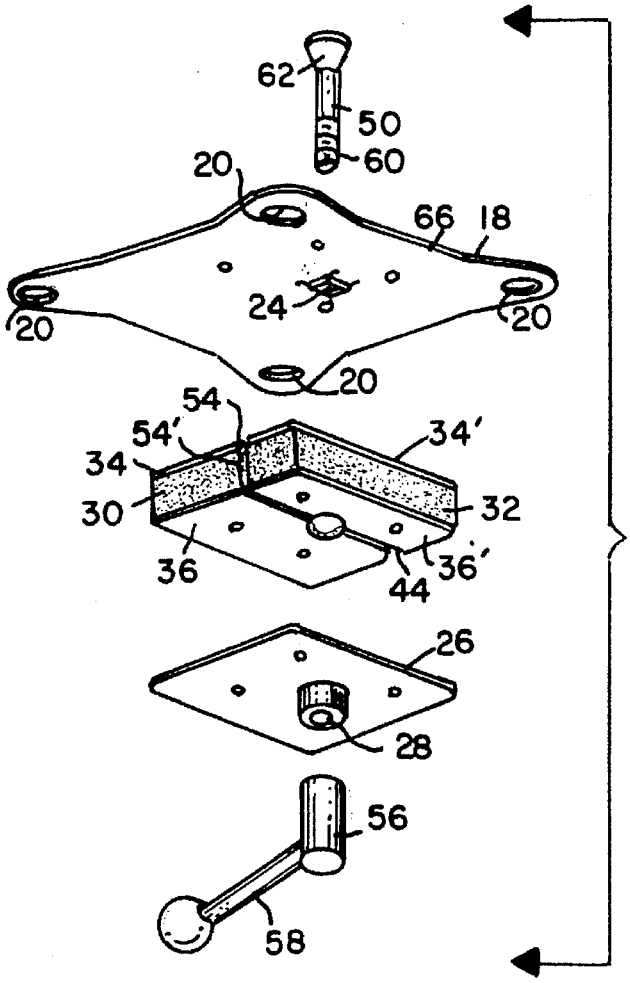
FIG. 2 is an exploded view of the tilt control mechanism constructed according to the principles of the present invention.

The chair tilt control mechanism 10 comprises an uppermost generally rectilinear top mounting plate 18, as may be seen in FIGS. 1 and 2. The top mounting plate 18, has a mounting hole 20 at each corner thereof, for attachment via bolts or rivets or the like, to the molded seat portion 12 of the chair. The top mounting plate 18, has a bolt opening 24 disposed along the longitudinal center line of the top mounting plate 18. The bolt opening 24 is arranged within the forwardmost half of the top mounting plate 18. The tilt control mechanism 10 also includes a lower mounting plate 26 of generally rectilinear configuration, also having a central bolt opening 28 therethrough. The lower mounting plate 26 is fixedly attached to the distal end of the forward support arm 16, which arm 16 extends from the chair assembly support column 14. The lower mounting plate 26 is generally parallel to the top mounting plate 18, when there is no one sitting in the chair seat 12.

A pair of rectangularly shaped resilient blocks 30 and 32, are disposed between the top mounting plate 18 and the lower mounting plate 26. The resilient blocks 30 and 32 are formed of compressible rubber material such as neoprene, or the like, and comprise a "forward" resilient block 32 and a "rearward" resilient block 30. Each resilient block 30 and 32 is of the same thickness and of the same width. The forward resilient block 32 has a forward to rearward dimension of about ⅓ that of the forward to rearward dimension of the rearward resilient block 30, as may be seen in the side elevational view of FIG. 1. Preferably, each resilient block 30 and 32 has a top face plate 34 and 34', respectively, and a bottom face plate 36 and 36' respectively, secured thereto. Each top face plate 34 and 34', of each resilient block 30 and 32, is fixedly secured as by fusing or adhesive or the like, to each respective resilient block 30 and 32. The top face plates 34 and 34' are secured to the top mounting plate 18, by a plurality of threaded inserts 40 threadedly received therein.

The bottom face plates 36 and 36' and their respective resilient blocks 30 and 32 are secured together as by fusing or adhesives or the like. The lower mounting plate 26 is attached to the bottom face plates 36 and 36' by a plurality of threaded inserts 42 extending through the lower mounting plate 26 which inserts 42 are threadedly received into the bottom face plates 36 and 36'. In an alternative embodiment, each resilient block 30 and 32 may be comprised of a plurality of smaller blocks of circular or polygonal peripheral configuration, not shown, of similar thickness, but of different radii or side dimensions. The smaller blocks would be collectively attached between a pair of plates in a manner similar to each of the pair of resilient blocks 30 and 32 aforementioned.

In the preferred embodiment, the forward and rearward resilient blocks 30 and 32 are spaced apart from one another by a gap 44 of about ⅛ inch, as may be seen in FIG. 2. The spaced apart gap 44 between the forward and rearward resilient blocks 30 and 32 is disposed transversely with respect to the forward and rearward longitudinal axis of the chair seat 12 and to the longitudinal axis of the support arm 16.

A threaded fixed bolt 50 extends through the generally conically shaped central opening 24 in the top mounting plate 18 and extends within a channel 52 formed in each respective adjacent side 54 and 54' of the forward and rearward resilient blocks 32 and 30 which face one another, the bolt 50 extending through the central bolt opening 28 in the lower mounting plate 26, and being received into a rotatable threaded hub 56 therebeneath. The threaded hub 56 at the lowermost side of the lower mounting plate 26, has an adjustment handle 58 thereon, the handle 58 being rotatably engaged with the threads 60 on the lowermost end of the threaded fixed bolt 50 extending through the blocks 30 and 32 of the tilt control mechanism 10.

The uppermost end of the threaded fixed bolt 50 has a generally conical shaped head 62 which mates within the central bolt opening 24 at the top mounting plate 18.

Movement of an individual seated in the chair seat 12 portion of the chair assembly may, by moving forward (to the right as may be seen in FIG. 1), create a first short moment arm around the top of the threaded fixed bolt 50 by having the forward transverse edge 66 of the top mounting plate 18 pivot downwardly about a short fulcrum between the longitudinal axis about the threaded fixed bolt 50 and the forward edge of the forward resilient block 32. The shorter "forward to rearward" dimension of the "forward" resilient block 32 thereby provides a less resistance to compressibility and thus permits an easier pivoting of the forward edge of the chair downwardly, than would a rearward moment, compressing the "rearward" resilient block 30, because of the rearward resilient block's greater "rearward to forward" dimension thereof. The greater dimension and mass of the "rearward" resilient block 30 thus providing a slightly different, longer length, greater mass to resist compression than the resistance to compression provided by the smaller forward block 32 having a shorter distance between the forward edge of the forward block 32 and the longitudinal axis of the (compression adjuster) threaded fixed bolt 50.

The threaded hub 56 on the lower end of the fixed bolt 50 may be rotated with respect to the lower end of that threaded fixed bolt 60, so as to compress or decompress the forward and rearward resilient blocks 32 and 30, between the top mounting plate 18 and the lower mounting plate 26, thus affecting their compressibility, and thus the forward and rearward tiltability of the top mounting plate 18 and hence tiltabilty of the lower seat support portion 12 of the chair assembly.

Thus, what has been shown is a unique adjustable tilt control mechanism 10 which may be tightened so as to minimize the forward and rearward tilt of a particular chair, or which may be adjusted to decompress those respective resilient blocks 30 and 32, and thus permit a greater forward and rearward tilting of the seat portion of the molded chair assembly.

Figure 3:
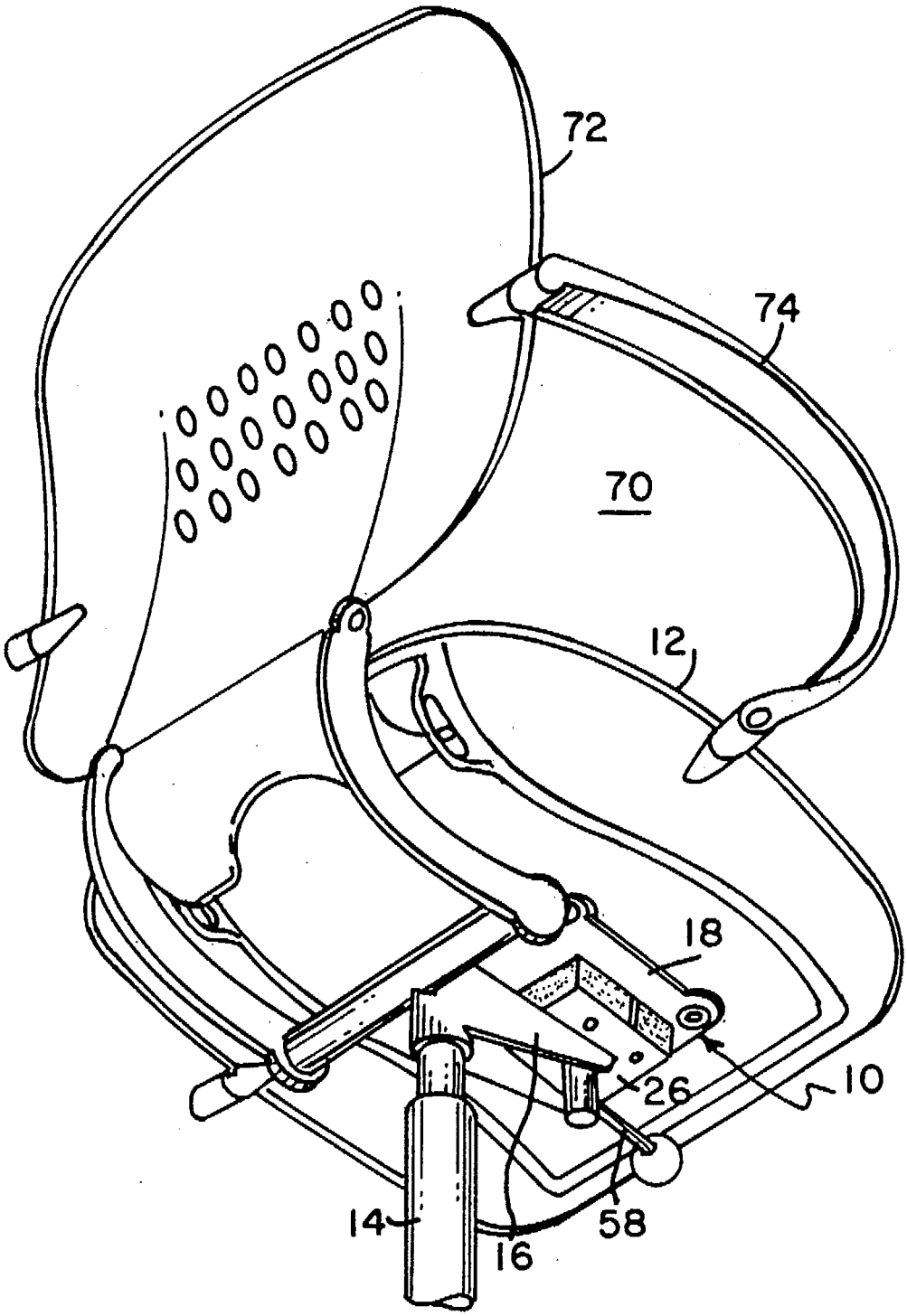
FIG. 3 is a perspective view of a chair assembly, from a lower most portion thereof showing the tilt control mechanism arranged on a support column thereattached.

The view shown in FIG. 3 displays the tilt adjustment mechanism 10 and the support column 14 relative to the bottom side 11 of the seat 12 and the chair assembly 70 itself, which includes a back portion 72 and flexible armrests 74.

I claim:

1. A manually adjustable tilt control mechanism permitting adjustable control of the front to back tilt of a chair assembly on a support frame, comprising:

a chair assembly having a lowermost seat portion;

a column and forwardly extending support arm, for supporting the chair seat portion;

a pair of commonly-controlled compressible, spaced-apart dissimilarly-sized resilient blocks each sandwiched between a top face plate and a lower face plate, and are disposed between the end of said support arm and the bottom side of said chair seat portion, which blocks have an adjustable threaded bolt means disposed therebetween, for commonly adjusting the compression or decompression of both of said blocks, to affect the tiltability of said chair seat.

2. A manually adjustable tilt control mechanism as recited in claim 1, wherein each of said resilient blocks, are of rectilinear shape, a first of said blocks having a forward to rearward dimension which is smaller than the forward to rearward dimension of the second of said resilient blocks.

3. The manually adjustable tilt control mechanism as recited in claim 2, wherein said first and second resilient blocks, are separated by a thin transversely disposed gap extending therebetween.

4. A manually adjustable tilt control mechanism as recited in claim 3, wherein said tilt control mechanism also includes a top mounting plate and a lower mounting plate between which said resilient blocks and top face plate and bottom face plate are sandwiched there between.

5. A manually adjustable tilt control mechanism, as recited in claim 4, wherein said top mounting plate and said lower mounting plate each have a center bolt locating hole in axial alignment with one another, and wherein said resilient blocks each have a channel on their contiguous side portions, so as to permit a passageway for a threaded bolt therethrough.

6. A manually adjustable tilt control mechanism as recited in claim 5, wherein said threaded bolt fits through said central openings in said top mounting plate, said lower mounting plate, and said channel between said respective resilient blocks, and mates into a threaded hub on the lower side of said lower mounting plate for adjustment of said resilient blocks therebetween.

7. A manually adjustable tilt control mechanism as recited in claim 6, wherein said first or forwardmost resilient block has a forward to rearward dimension which is less than the forward to rearward dimension of said second or rearward resilient block.

8. A manually adjustable tilt control mechanism, as recited in claim 7, wherein said top mounting plate is tiltable with respected to said threaded bolt extending therethrough.

9. A manually adjustable tilt control mechanism, as recited in claim 8, wherein said threaded hub has a handle extending radially therefrom, to permit said threaded hub to be rotated with respect to said lower mounting plate, thereby effecting compression or decompression on said resilient blocks spaced between said top mounting plate and said lower mounting plate.

10. A manually adjustable tilt control mechanism, as recited in claim 5, wherein said top mounting plate is attached to the lower side of said chair by a plurality of securement members therethrough.

11. A method of adjusting the tiltability of a chair seat, comprising the steps of:

attaching a pair of differently sized spaced-apart resilient blocks to the lower side of said seat;

arranging a support arm onto the lower side of said resilient blocks, to provide support for said chair seat;

placing a compression adjustment means between said resilient blocks, so as to adjustably commonly compress or decompress each of said blocks; and adjusting said compression adjustment means, so as to tighten and squeeze each of said spaced apart blocks, to commonly reduce their further compressibility, and thus reduce the tiltability of said chair seat.

12. The method of claim 11, including the step of:

adjusting said compression adjustment means, so as to release and decompress said resilient blocks so as to enhance their further compressibility, and thus enhance the tiltability of said chair seat.

13. The method of claim 11, including the step of:

positioning a threaded bolt through an opening between said resilient blocks, which threaded bolt is attached to said support arm, to allow said adjustment of compressibility.

14. The method of claim 11, including the step of:

fixing the forward to rearward length of a forwardmost block at less than the forward to rearward length of a rearwardmost block, to effect a greater mass in the rearmost block than the forwardmost block, thus effecting differing resistance to compressibility and hence tiltability therein.

15. A manually adjustable tilt control mechanism permitting adjustable control of the front to back tilt of a chair assembly on a support frame, comprising:

a chair assembly having a lowermost seat portion;

a column and forwardly extending support arm, for supporting the chair seat portion;

a pair of dissimilarly sized spaced-apart resilient blocks having a thin gap therebetween, said blocks being disposed between the end of said support arm and the bottom side of said chair seat portion, both of said blocks being commonly compressible by an adjustable compression member disposed in said gap therebetween, to affect the tiltability of said chair seat.

16. The manually adjustable tilt control mechanism of claim 15, wherein each of said blocks has an upper and a lower plate attached thereto, for securement to said seat and support arm respectively.

* * * * *